US009512830B2

(12) United States Patent
Hikichi et al.

(10) Patent No.: US 9,512,830 B2
(45) Date of Patent: Dec. 6, 2016

(54) RECIPROCATING COMPRESSOR

(75) Inventors: Takumi Hikichi, Osaka (JP); Ichiro Kita, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 404 days.

(21) Appl. No.: 14/004,346

(22) PCT Filed: Mar. 9, 2012

(86) PCT No.: PCT/JP2012/001645

§ 371 (c)(1),
(2), (4) Date: Sep. 10, 2013

(87) PCT Pub. No.: WO2012/120900

PCT Pub. Date: Sep. 13, 2012

(65) Prior Publication Data

US 2014/0000451 A1 Jan. 2, 2014

(30) Foreign Application Priority Data

Mar. 10, 2011 (JP) ..... 2011-052659

(51) Int. Cl.
*F04B 39/02* (2006.01)
*F04B 1/00* (2006.01)
*F04B 53/00* (2006.01)

(52) U.S. Cl.
CPC ..... *F04B 1/00* (2013.01); *F04B 39/023* (2013.01); *F04B 53/008* (2013.01); *F04B 39/0246* (2013.01)

(58) Field of Classification Search
CPC ..... F04B 39/0246
See application file for complete search history.

(56) References Cited

U.S. PATENT DOCUMENTS 2,583,583 A 1/1952 Mangan
2003/0223891 A1 12/2003 Nissen et al.

FOREIGN PATENT DOCUMENTS

JP 7-167055 7/1995
JP 7-208337 8/1995
JP 7-259737 10/1995
JP 7-259738 10/1995
(Continued)

*Primary Examiner* — F. Daniel Lopez
(74) *Attorney, Agent, or Firm* — Hamre, Schumann, Mueller & Larson, P.C.

(57) ABSTRACT

A reciprocating compressor of the present invention includes an electric component (6), a compression component (9), and a container (1). The compression component includes a cylinder (14), a piston (16), an eccentric shaft (33), a piston pin (23), a connecting rod (22), an oil feeding mechanism (51), a communicating passage (22*c*), an oil feeding passage (23*a*), a communicating hole (22*d*) which is provided in the connecting rod such that a smaller-shaft hole (22*b*) and an internal space of the piston are communicated with each other via the communicating hole, and discharges the oil fed to the smaller-shaft hole to the internal space of the piston; and an oil feeding port (23*b*) provided in the piston pin such that the oil feeding passage and the smaller-shaft hole are communicated with each other via the oil feeding port and feeds the oil fed to the smaller-shaft hole to the oil feeding passage; wherein the oil feeding port is provided in the piston pin in a location other than a location facing a location at which the communicating passage opens in the smaller-shaft hole.

6 Claims, 12 Drawing Sheets

(56) References Cited

FOREIGN PATENT DOCUMENTS

| | | |
|---|---|---|
| JP | 7-293443 | 11/1995 |
| JP | 10-281068 | 10/1998 |
| JP | 2000-345965 | 12/2000 |
| JP | 2008-82260 | 4/2008 |
| JP | 2010-53727 | 3/2010 |

RECIPROCATING COMPRESSOR

TECHNICAL FIELD

The present invention relates to a sealed compressor. In particular, the present invention relates to a sealed compressor for use in a refrigeration cycle device, an air compressor, etc.

BACKGROUND ART

In recent years, there has been an increasing demand for protection of global environment. In particular, there has been a strong demand for a higher efficiency in a sealed compressor incorporated into a refrigerator, other refrigeration cycle devices, etc. To achieve this, a driving power loss in the sealed compressor is reduced by sufficiently feeding oil to slide portions.

For example, in a conventional sealed compressor, a refrigerant oil is suctioned up by rotation of a rotary shaft. When the refrigerant oil reaches an eccentric shaft at an upper portion of the rotary shaft, lubricating oil is scattered out from an oil feeding hole of the eccentric shaft and is applied downward onto a compression mechanism. This allows the refrigerant oil to be fed to slide portions of a cylinder and of a piston (prior art example 1: for example, see Patent Literature 1).

The lubricating oil is suctioned up from a bottom portion of a sealed container through an oil feeding pipe of a crankshaft, and flows into an oil feeding hole of a piston pin via an oil feeding communication passage of a connecting rod. When the piston pin moves in a direction to increase an internal space of a cylinder, the oil feeding hole is communicated with an internal space of the sealed container. Thereby, the lubricating oil is fed to slide portions of the piston and of the cylinder through the oil feeding hole (prior art example 2: for example, see Patent Literature 2).

CITATION LIST

Patent Literature

Patent Literature 1: Japanese-Laid Open Patent Application Publication No. 2010-53727

Patent Literature 2: Japanese-Laid Open Patent Application Publication No. 2000-345965

SUMMARY OF INVENTION

Technical Problem

However, in the prior art example 1, since the high-temperature refrigerant oil is scattered out from the upper portion of the rotary shaft, it is scattered around the entire sealed container as well as the compression mechanism. Because of this, the refrigerant oil is mixed with a gaseous refrigerant inside of the sealed container, so that the gaseous refrigerant is heated. This gaseous refrigerant raises its temperature, and increases its specific volume. This results in a reduction of an amount of the gaseous refrigerant suctioned into a chamber of the cylinder and hence reduction of a volumetric efficiency of the sealed compressor.

In a state in which the gaseous refrigerant is mixed into the refrigerant oil, the gaseous refrigerant becomes bubbles, which stay in the refrigerant oil. When this refrigerant oil is fed to the slide portions, it is formed into a lubricating film on the slide portions. However, there is a region of the slide portions where no lubricating film is formed, because of presence of the bubbles. In this region, friction, wear, etc., occurs significantly, which results in a driving power loss in the sealed compressor or a reduction of a life of the sealed compressor.

In the prior art example 2, the lubricating oil suctioned up from the bottom portion of the sealed container is applied to the slide portions via the oil feeding communication passage or the oil feeding hole. In the bottom portion of the sealed container, solid substances such as abrasion powder of metal generated in the slide portions and solid oxides generated by welding of a pipe, or the like, are deposited, together with the lubricating oil. If the lubricating oil containing the solid substances is fed to the slide portions, the solid substances may damage the slide portions, in some cases. This may result in a reduction of a life of the sealed compressor.

The present invention is directed to solving the above described problem, and an object of the present invention is to provide a reciprocating compressor which can reduce its driving power loss, improve its volumetric efficiency, and extend its life.

Solution to Problem

According to an aspect of the present invention, there is provided a reciprocating compressor comprising: an electric component; a compression component actuated by the electric component; and a container which accommodates the electric component and the compression component and stores oil; wherein the compression component includes: a cylinder; a piston which has an internal space which opens at an opposite side of a head portion thereof and is reciprocatable inside of the cylinder; an eccentric shaft rotated by the electric component around an axis parallel to an axis of the eccentric shaft; a piston pin provided in the piston so as to extend transversely in the internal space; a connecting rod one end portion of which is rotatably fitted to the eccentric shaft and the other end portion of which is inserted into the internal space of the piston, the connecting rod being rotatably fitted to the piston pin in a smaller-shaft hole formed in the other end portion; an oil feeding mechanism for feeding the oil stored in the container to a specified region of the connecting rod; a communicating passage provided inside of the connecting rod such that the smaller-shaft hole and the specified region are communicated with each other via the communicating passage, to feed the oil fed to the specified region by the oil feeding mechanism to the smaller-shaft hole; an oil feeding passage which extends in an axial direction of the piston pin and opens in an outer peripheral surface of the piston; a communicating hole which is provided in the connecting rod such that the smaller-shaft hole and the internal space of the piston are communicated with each other via the communicating hole, and discharges the oil fed to the smaller-shaft hole to the internal space of the piston; and an oil feeding port which is provided in the piston pin such that the oil feeding passage and the smaller-shaft hole are communicated with each other via the oil feeding port and feeds the oil fed to the smaller-shaft hole to the oil feeding passage; wherein the oil feeding port is provided in the piston pin in a location other than a location facing a location at which the communicating passage opens in the smaller-shaft hole.

Advantageous Effects of Invention

The present invention has the above described configuration, and has advantages that it is possible to provide a reciprocating compressor which can reduce its driving power loss, improve its volumetric efficiency, and extend its life.

The above and further objects and features of the invention will more fully be apparent from the following detailed description with accompanying drawings.

DESCRIPTION OF EMBODIMENTS

Figure 1:
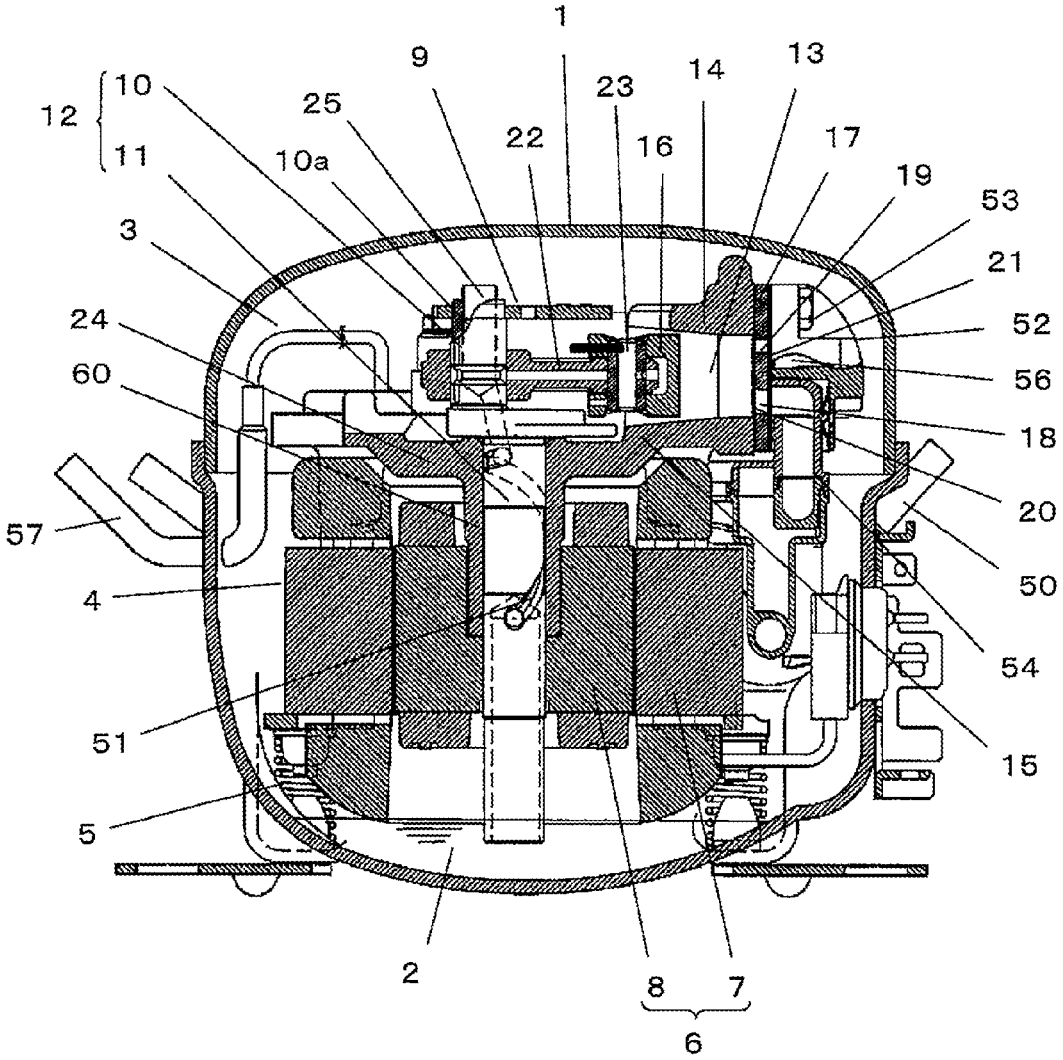
FIG. 1 is a longitudinal sectional view showing a reciprocating compressor according to Embodiment 2 of the present invention.

According to an embodiment of the present invention, there is provided a reciprocating compressor comprising: an electric component; a compression component actuated by the electric component; and a container which accommodates the electric component and the compression component and stores oil; wherein the compression component includes: a cylinder; a piston which has an internal space which opens at an opposite side of a head portion thereof and is reciprocatable inside of the cylinder; an eccentric shaft rotated by the electric component around an axis parallel to an axis (center axis) of the eccentric shaft; a piston pin provided in the piston so as to extend transversely in the internal space; a connecting rod one end portion of which is rotatably fitted to the eccentric shaft and the other end portion of which is inserted into the internal space of the piston, the connecting rod being rotatably fitted to the piston pin in a smaller-shaft hole formed in the other end portion; an oil feeding mechanism for feeding the oil stored in the container to a specified region of the connecting rod; a communicating passage provided inside of the connecting rod such that the smaller-shaft hole and the specified region are communicated with each other via the communicating passage, to feed the oil fed to the specified region by the oil feeding mechanism to the smaller-shaft hole; an oil feeding passage which extends in an axial direction of the piston pin and opens in an outer peripheral surface of the piston; a communicating hole which is provided in the connecting rod such that the smaller-shaft hole and the internal space of the piston are communicated with each other via the communicating hole, and discharges the oil fed to the smaller-shaft hole to the internal space of the piston; and an oil feeding port which is provided in the piston pin such that the oil feeding passage and the smaller-shaft hole are communicated with each other via the oil feeding port and feeds the oil fed to the smaller-shaft hole to the oil feeding passage; wherein the oil feeding port is provided in the piston pin in a location other than a location facing a location at which the communicating passage opens in the smaller-shaft hole.

The reciprocating compressor may further comprise: an oil groove provided in an outer peripheral surface of the piston pin or an inner peripheral surface of the smaller-shaft hole of the connecting rod such that the communicating passage and the communicating hole are communicated with each other via the oil groove.

In the reciprocating compressor, the oil feeding port may be provided in the piston pin such that the oil groove and the oil feeding passage are communicated with each other via the oil feeding port.

In the reciprocating compressor, the oil feeding port may be provided in the piston pin in a location facing a location at which the communicating hole opens in the smaller-shaft hole when the connecting rod is rotating relative to the piston pin.

In the reciprocating compressor, the specified region of the connecting rod may be a larger-shaft hole which is formed at one end portion of the connecting rod and into which the eccentric shaft is fittingly inserted, the reciprocating compressor may further comprise a main shaft having one end portion to which the eccentric shaft is connected such that an axis (center axis) of the main shaft and an axis of the eccentric shaft are eccentric with respect to each other; the other end portion of the main shaft being immersed in a storage section of the oil, and the main shaft being rotated by the electric component around the axis of the main shaft; wherein the oil feeding mechanism may include an oil feeding passage which is provided from the other end portion of the main shaft to an outer peripheral surface of a fitting insertion portion of the eccentric shaft which is fittingly inserted into the larger-shaft hole of the connecting rod, and feeds the oil stored in the storage section to the outer peripheral surface of the fitting insertion portion of the eccentric shaft; and the reciprocating compressor may further comprise: an oil feeding groove provided in the outer peripheral surface of the fitting insertion portion of the eccentric shaft or an inner peripheral surface of the larger-shaft hole of the connecting rod such that the oil feeding passage and the communicating passage are communicated with each other via the oil feeding groove.

In the reciprocating compressor, the oil feeding groove may cause the oil feeding passage and the communicating passage to be substantially communicated with each other in a state in which the piston is in a suction stroke, and causes the oil feeding passage and the communicating passage not to be substantially communicated with each other in a state in which the piston is in a compression stroke.

In the reciprocating compressor, the oil feeding groove may be configured such that a gap formed between the inner peripheral surface of the larger-shaft hole of the connecting rod and the outer peripheral surface of the fitting insertion portion of the eccentric shaft decreases as the gap is closer to its both ends.

The reciprocating compressor may further comprises a discharge hole provided in the connecting rod such that the communicating passage and inside of the container are communicated with each other via the discharge hole.

Hereinafter, embodiments of the present invention will be described with reference to the drawings.

Throughout the drawings, the same or corresponding components are identified by the same reference symbols and will not be described in repetition.

For easier explanation, a direction corresponding with an axis of a main shaft actuated by an electric component will be referred to as a longitudinal direction, and a direction perpendicular to the longitudinal direction will be referred to as a transverse direction. Although it is supposed that in the drawings and description, the reciprocating compressor is configured such that a piston is horizontally reciprocatable, the present invention is not limited to this. The reciprocating compressor may be designed such that the piston is reciprocatable in any direction.

Embodiment 1

Figure 10:
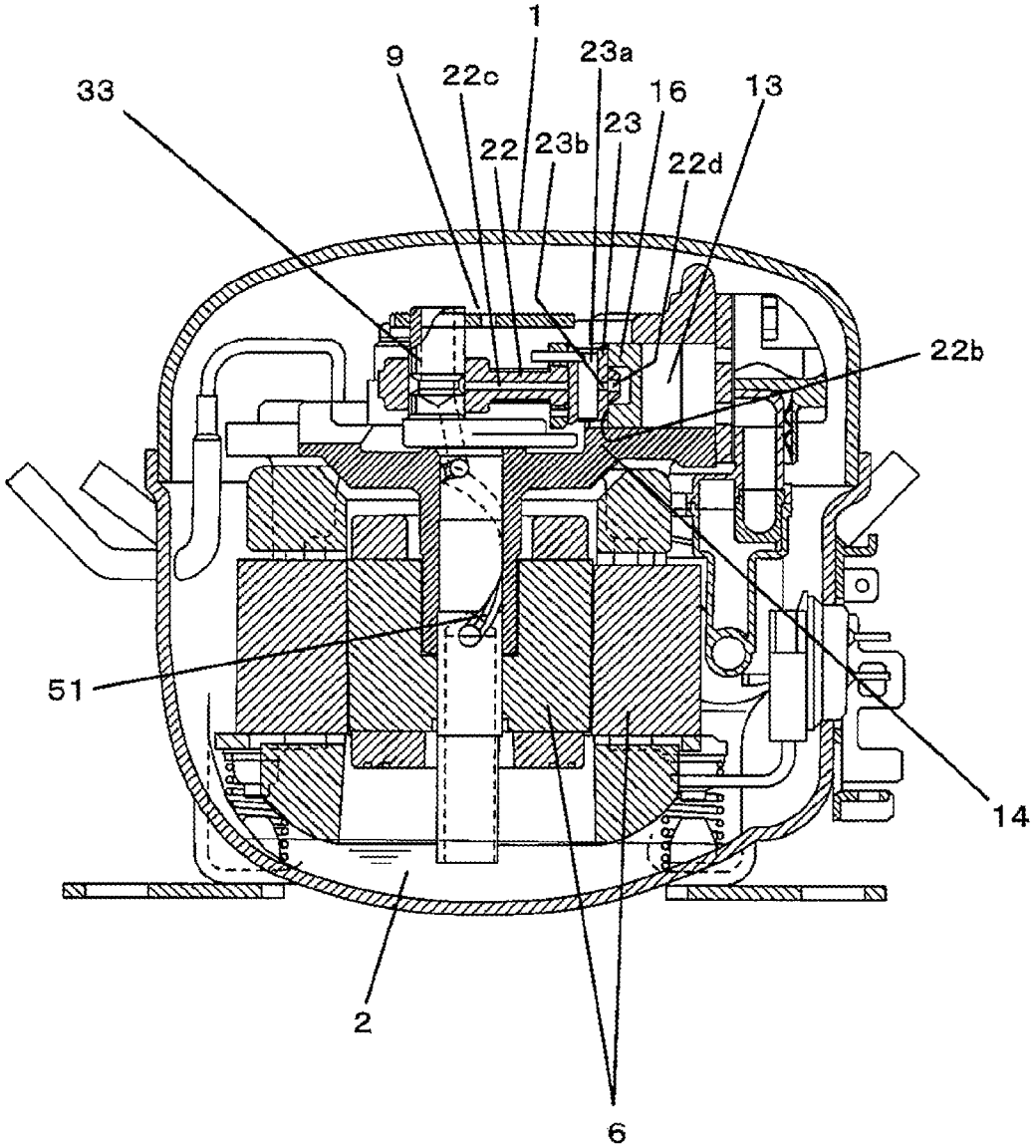
FIG. 10 is a longitudinal sectional view showing a reciprocating compressor according to Embodiment 1 of the present invention.

FIG. 10 is a longitudinal sectional view showing a reciprocating compressor according to Embodiment 1.

In the example of FIG. 10, the reciprocating compressor includes an eccentric shaft 10, a connecting rod 22, an oil feeding mechanism 32, a communicating passage 22*c*, and a communicating hole 22*d*. Instead of these components, the reciprocating compressor includes an eccentric shaft 33, a connecting rod 34, a communicating hole 34*c*, an oil feeding mechanism 51, a communicating passage 34*a*, and a communicating hole 34*c*, which are shown in FIGS. 6 to 9. Or, the reciprocating compressor may include components other than the above components, to provide a desired configuration.

The reciprocating compressor includes an electric component 6, a compression component 9 actuated by the electric component 6, and a container 1 which accommodates the electric component 6 and the compression component 9 and stores oil 2. A working fluid compressed by the compression component 9 is not particularly limited so long as the working fluid is a gaseous fluid. As examples of the working fluid, there are refrigerant, air, etc.

The compression component 9 includes a cylinder 14, a piston 16, a piston pin 23, the connecting rod 22, the oil feeding mechanism 51, the communicating passage 22*c*, an oil feeding passage 23*a*, the communicating hole 22*d*, and an oil feeding port 23*b*.

The cylinder 14 includes a compression chamber 13 as its internal space.

The piston 16 has an internal space 16*b* which opens at an opposite side of its head portion and is reciprocatable inside of the compression chamber 13 of the cylinder 14.

The electric component 6 causes the eccentric shaft 33 to rotate around an axis parallel to an axis of the eccentric shaft 33.

The piston pin 23 is provided in the piston 16 so as to extend transversely in the internal space 16*b*.

The connecting rod 22 is rotatably fitted at one end portion thereof to the eccentric shaft 33. The other end portion of the connecting rod 22 is inserted into the internal space 16*b* of the piston 16. The connecting rod 22 is rotatably fitted to the piston pin 23 in a smaller-shaft hole 22*b* formed in the other end portion thereof The oil feeding mechanism 51 feeds the stored oil 2 to a specified region of the connecting rod 22. As the specified region, a desired region of the connecting rod 22 can be selected. The oil feeding mechanism 51 may be configured as desired.

The communicating passage 22*c* is provided inside of the connecting rod 22 such that the smaller-shaft hole 22*b* and the specified region are communicated with each other via the communicating passage 22*c*. Through the communicating passage 22*c*, the oil 2 fed from the oil feeding mechanism 51 to the specified region is fed to the smaller-shaft hole.

An oil feeding passage 23*a* extends in an axial direction of the piston pin 23 and opens in an outer peripheral surface of the piston 16.

The communicating hole 22*d* is provided in the connecting rod 22 such that the smaller-shaft hole 22*b* and the internal space 16*b* of the piston 16 are communicated with each other via the communicating hole 22*d*. Through the communicating hole 22*d*, the oil 2 fed to the smaller-shaft hole 22*b* is discharged to the internal space 16*b* of the piston.

The oil feeding port 23*b* is provided in the piston pin 23 such that the oil feeding passage 23*a* and the smaller-shaft hole 22*b* are communicated with each other via the oil feeding port 23*b*. Through the oil feeding port 23*b*, the oil 2 fed to the smaller-shaft hole 22*b* is fed to the oil feeding passage 23*a*. The oil feeding port 23*b* is provided in the piston pin 23 in a location other than a location facing a location at which the communicating passage 22*c* opens in the smaller-shaft hole 22*b*.

In the reciprocating compressor having the above configuration, when the electric component 6 causes the eccentric shaft 33 to rotate, the connecting rod 22 converts this rotational motion into a reciprocating motion of the piston 16. Thus, the piston 16 reciprocates inside of the compression chamber 13 of the cylinder 14. According to this reciprocating motion, the working fluid (gas) is suctioned from outside into the container 1, and the working fluid is discharged from inside of the container 1 to outside.

According to the rotation of the eccentric shaft 33, the oil feeding mechanism 51 feeds the oil 2 stored inside of the container 1 to the specified region of the connecting rod 22. The oil 2 is fed from the specified region of the connecting rod 22 to the smaller-shaft hole 22*b* of the connecting rod 22 via the communicating passage 22*c*. A part of the oil 2 is fed from the smaller-shaft hole 22*b* of the connecting rod 22 to the oil feeding passage 23*a* through the oil feeding port 23*b*. The oil in the oil 2 feeding passage 23*a* flows out through the opening in the outer peripheral surface of the piston 16.

As a result, the oil 2 flows into a clearance between the cylinder 14 and the piston 16 and lubricates the slide portions of the cylinder 14 and of the piston 16.

Furthermore, a part of the oil 2 is discharged from the smaller-shaft hole 22*b* of the connecting rod 22 to the internal space 16*b* of the piston through the communicating hole 22*d*. Therefore, even when the oil 2 contains solid substances such as abrasion powder of metal and solid oxides, and the working fluid, the solid substances and the working fluid are discharged to the inner space 16*b* of the piston 16 through the communicating hole 22*d*. This makes it possible to prevent a situation in which the solid substances enter a clearance between the slide portions and damage them. In addition, it becomes possible to prevent discontinuity of an oil film formed on the slide portions, which would be caused by the working fluid, and hence reduce friction and wear of the slide portions.

In accordance with the above configuration, the oil 2 is fed to the slide portions of the piston 16 and of the cylinder 14 via the oil feeding port 23*b* and the oil feeding passage 23*a*. In this way, the oil 2 lubricates the slide portions, which can reduce a driving power loss in the slide portions.

The oil 2 is fed to the slide portions via the oil feeding port 23*b* and the oil feeding passage 23*a*. This makes it possible to realize a situation in which no oil is scattered out from the upper portion of the eccentric shaft 33 or an amount of the oil 2 scattered therefrom is reduced. Therefore, it is possible to suppress a situation in which the working fluid is heated by the high-temperature oil 2, and suppress a temperature increase in the working fluid. Also, reduction of an amount of the working fluid suctioned into the compression chamber 13 can be prevented, and a volumetric efficiency of the sealed compressor can be improved.

Since no oil is scattered or the amount of the oil 2 scattered is reduced, it is possible to prevent a situation in which the working fluid is mixed into the oil 2. Besides, since the oil feeding port 23*b* is provided in the location other than the location facing the location at which the communicating passage 22*c* opens in the smaller-shaft hole 22*b*, the oil 2 from the communicating passage 22*c* flows through the communicating hole 22*d* as well as the oil feeding port 23*b*. Therefore, the working fluid and the solid substances are discharged from the communicating hole 22*d* to inside of the container 1 through the internal space 16*b* of the piston 16. As a result, a driving power loss in the sealed compressor can be reduced, and a life of the sealed compressor can be extended.

Embodiment 2

In Embodiment 2, the reciprocating compressor of Embodiment 1 is applied to a reciprocating compressor configured to feed the oil to the larger-shaft hole in the larger-end portion of the connecting rod, as the specified region, which is fitted to the eccentric shaft.

Figure 2:
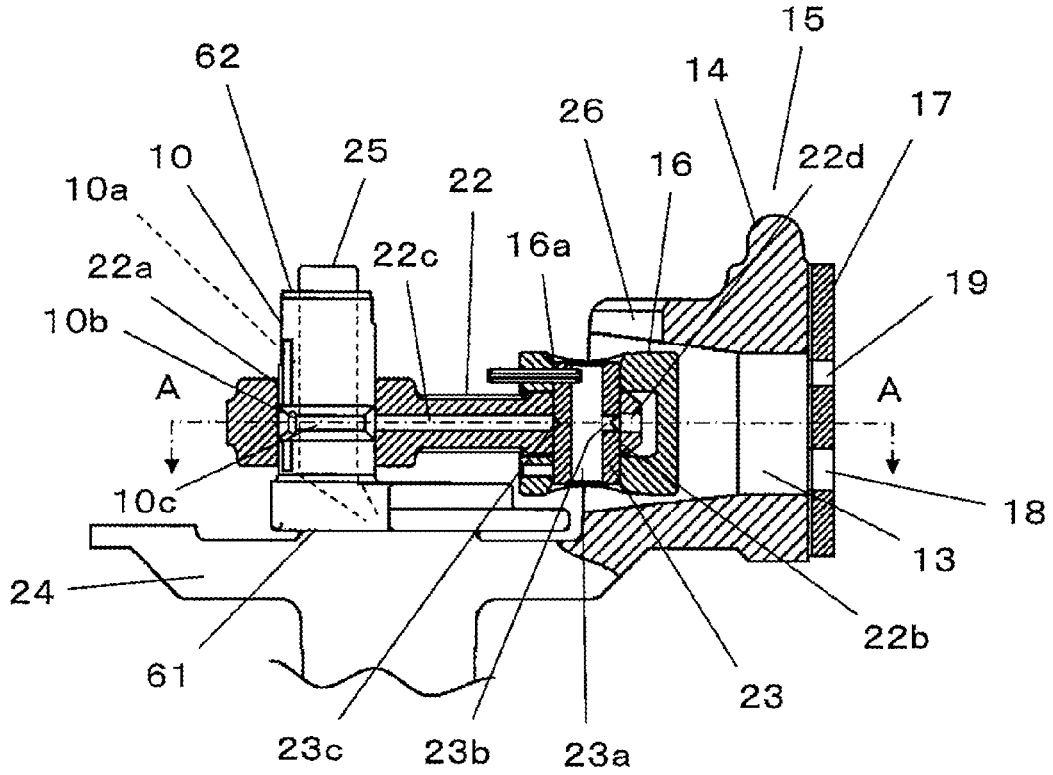
FIG. 2 is an enlarged sectional view showing slide portions of a piston and of a cylinder of FIG. 1.
Figure 3:
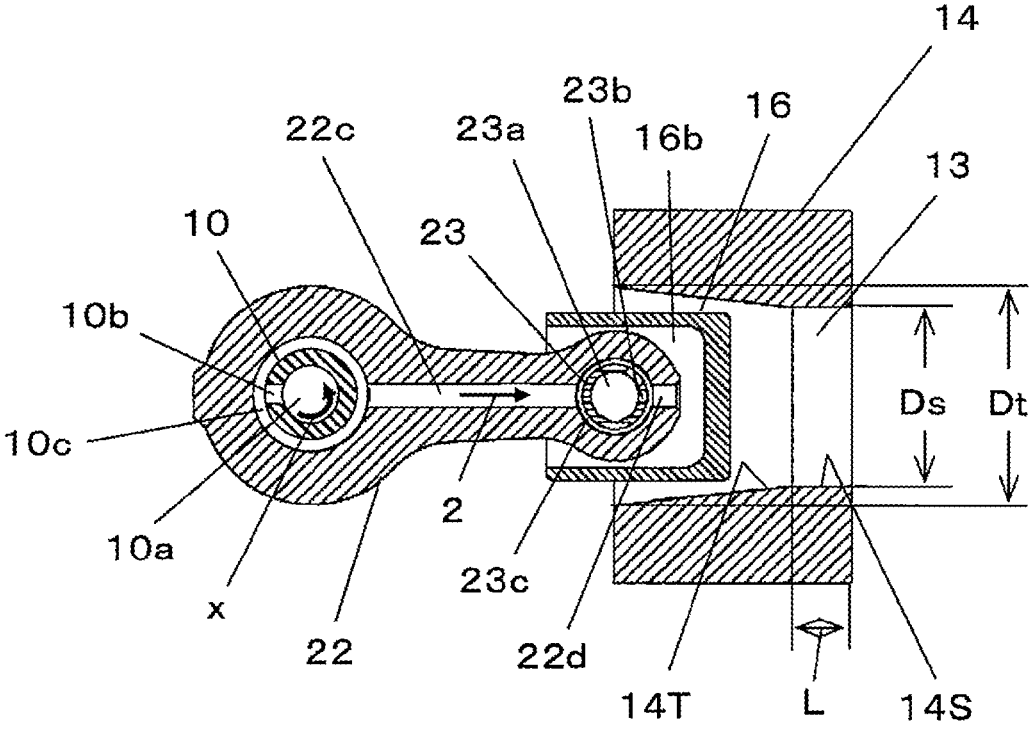
FIG. 3 is a cross-sectional (transverse-sectional) view showing the slide portions taken along line A-A of FIG. 2.

FIG. 1 is a longitudinal sectional view showing the reciprocating compressor according to Embodiment 2. FIG. 2 is an enlarged sectional view showing the slide portions of the piston 16 and of the cylinder 14. FIG. 3 is a cross-sectional view showing the slide portions taken along line A-A of FIG. 2.

The reciprocating compressor includes the container 1.

The container 1 is manufactured by, for example, drawing process of an iron plate. The oil 2 is stored in the bottom portion of the container 1. The container 1 is filled with the working fluid 3. Hereinafter, a case where refrigerant is used as the working fluid 3 will be exemplarily described. However, the working fluid 3 is not particularly limited so long as it is a gas. As the refrigerant, for example, hydrocarbon-based refrigerant such as R600a, which is low in global warming coefficient, is used. A suction pipe 50 used to suction the working fluid 3 and a discharge pipe 57 used to discharge the working fluid 3 are connected to the container 1.

One end of the suction pipe 50 is communicated with an interior of the container 1, while the other end thereof is connected to a lower-pressure side (not shown) of the refrigeration cycle. One end of the discharge pipe 57 penetrates the container 1 and is communicated with a discharge muffler (not shown), while the other end thereof is connected to a higher-pressure side (not shown) of the refrigeration cycle.

A compression body 4 includes the compression element 9 and the electric component 6 for actuating the compression component 9. The compression body 4 is accommodated into the container 1 and is elastically supported on the container 1 by a suspension spring 5. As a suspension, a known desired configuration may be used.

The electric component 6 includes a stator 7 and a rotor 8. The stator 7 is fastened to a lower side of a cylinder block 15 by a bolt (not shown). The rotor 8 is placed at an inner side of the stator 7 and fastened to a main shaft 11 by shrink fitting (shrinkage-fit).

The compression element 9 includes a shaft 12, the cylinder block 15, the piston 16, the connecting rod 22, the piston pin 23, etc.

The shaft 12 includes the main shaft 11 and the eccentric shaft 10. The eccentric shaft 10 is connected to one end portion of the main shaft 11 such that an axis of the main shaft 11 and an axis of the eccentric shaft 10 are eccentric with respect to each other. The other end portion of the main shaft 11 is immersed in a storage section of the oil 2. The electric component 6 causes the other end portion of the main shaft 11 to rotate around its axis. A pump (not shown) is connected to a lower portion of the main shaft 11. The pump is immersed in the oil 2. The shaft 12 is provided with the oil feeding mechanism 51.

The oil feeding mechanism 51 is provided from the other end portion of the main shaft 11 to an outer peripheral surface of a fitting insertion portion of the eccentric shaft 10 which is fittingly inserted into the larger-shaft hole 22*a* of the connecting rod 22. The oil 2 stored in the container 1 is fed to the outer peripheral surface of the fitting insertion portion of the eccentric shaft 10. The oil feeding mechanism 51 includes a spiral passage formed inside of the main shaft 11, a spiral groove formed on the outer peripheral surface of the main shaft 11, a pump attached to a lower portion of the main shaft 11, the oil feeding passage 10*a* (as will be described later) and the oil feeding hole 10*b* (as will be described later). They are communicated with each other. The oil 2 flows from the pump attached to the lower portion of the main shaft 11, through the spiral passage, the spiral groove, and the oil feeding passage 10*a*, to the oil feeding hole 10*b*.

The oil feeding passage 10*a* is formed inside of the eccentric shaft 10 and extends in an axial direction of the eccentric shaft 10. The oil feeding passage 10*a* is formed by drilling in a direction from an upper end 62 of the eccentric shaft 10 using a machine such as an end mill or a drill press. An opening of the upper end 62 is sealed (closed) by a sealing member 25. The sealing member 25 is fastened to the upper end 62 by a fastening means such as screw engagement or welding. The oil feeding passage 10*a* is communicated with the oil feeding hole 10*b*.

The oil feeding hole 10*b* is formed inside of the eccentric shaft 10 and extends in a radial direction of the eccentric shaft 10. One end of the oil feeding passage 10*a* opens in the outer peripheral surface of the eccentric shaft 10, and is communicated with an oil feeding groove 10*c* as will be described later. The oil feeding hole 10*b* is provided in a location most distant from the communicating passage 22*c* as will be described later. That is, the oil feeding hole 10*b* and a location facing a location at which communicating passage 22*c* opens in the larger-shaft hole 22*a*, are symmetrical with respect to a point which is the eccentric shaft 10. This allows the oil 2 from the oil feeding hole 10*b* to flow uniformly in the entire oil feeding groove 33*a* and flow into the communicating passage 22*c*.

As described above, the shaft 12 is configured such that the oil feeding mechanism 51, the oil feeding passage 10*a*, and the oil feeding hole 10*b* are connected to each other, thereby forming an oil feeding path of the shaft 12. The oil feeding path of the shaft 12 is connected to an oil feeding path of the connecting rod 22 (as will be described later) including the oil feeding groove 10*c*.

The cylinder block 15 includes the cylinder 14 and a bearing unit 24. Each of the cylinder 14 and the bearing unit 24 has a substantially cylindrical shape. The cylinder 14 and the bearing unit 24 are placed such that their axes cross each other at a substantially right angle.

The bearing unit 24 includes a main bearing 60 and a thrust bearing 61. The main bearing 60 supports the main shaft 11 of the shaft 12 such that the main shaft 11 is rotatable. A lower end of the eccentric shaft 10 contacts the thrust bearing 61. In this manner, as shown in FIG. 2, the thrust bearing 61 forms a cantilever bearing.

A valve plate 17, a suction valve (not shown), and a cylinder head 52 are fastened to an end surface of a head portion side of the cylinder 14 by a head bolt 53. The valve plate 17 includes a suction hole 18 and a discharge hole 19. Via the suction hole 18 and the discharge hole 19, inside and outside of the compression chamber 13 are communicated with each other. A suction valve is provided on a surface of the valve plate 17 at the cylinder head 52 side, while a discharge valve (not shown) is provided on a surface of the valve plate 17 at an opposite side. The suction valve opens and closes the suction hole 18, while the discharge valve opens and closes the discharge hole 19. The cylinder head 52 covers the valve plate 17. A suction muffler 54 is retained and secured between the valve plate 17 and the cylinder head 52. The valve plate 17 and the cylinder head 52 define a head space 56.

The compression chamber 13 of a tubular shape is formed inside of the cylinder 14. As shown in FIG. 3, the cylinder 14 has a straight section 14S and a taper section 14T. The straight section 14S is provided in a section indicated by "L" which is a predetermined length from a top dead center side. The straight section 14S has an inner diameter dimension "Ds" which is constant in an axial direction thereof. The taper section 14T has an inner diameter dimension which increases from "Ds" to "Dt" (Dt>Ds) toward a bottom dead center side. Thus, the compression chamber 13 has a constant diameter in the straight section 14S and a diameter which increases in the taper section 14T.

A hollow portion 26 of FIG. 2 is formed in an upper portion of the cylinder 14.

The hollow portion 26 increases an opening of the compression chamber 13. When the piston 16 is in a position of the bottom dead center, the piston pin 23 is located outside of the compression chamber 13 and is exposed inside of the container 1 through the hollow portion 26.

The piston 16 is reciprocatingly inserted into the compression chamber 13.

The piston 16 is provided with a piston pin hole 16*a*.

The piston pin 23 is inserted into the piston pin hole 16*a*. The piston pin 23 has a cylindrical shape and has a hollow inner space. The piston pin 23 includes the oil feeding passage 23*a* and the oil feeding port 23*b*.

The oil feeding passage 23*a* is defined by the hollow inner space of the piston pin 23. The oil feeding passage 23*a* penetrates the piston pin 23 in an axial direction thereof. Upper and lower ends of the oil feeding passage 23*a* open in the outer peripheral surface of the piston 16 and are communicated with inside of the compression chamber 13. In a state in which the piston 16 is in the position of the bottom dead center, the upper end of the oil feeding passage 23*a* is communicated with inside of the container 1 via the compression chamber 13 and the hollow portion 26. Alternatively, only one of the upper and lower ends of the oil feeding passage 23*a* may open in the outer peripheral surface of the piston 16.

The oil feeding port 23*b* radially penetrates a peripheral wall of the piston pin 23. The oil feeding port 23*b* causes the oil feeding passage 23*a* and the oil groove 23*c* (as will be described later) to be communicated with each other. The oil feeding port 23*b* is provided in a location facing a location at which the communicating hole 22*d* opens in the smaller-shaft hole 22*b* when the connecting rod 22 is rotating with respect to the piston pin 23.

As described above, the piston pin 23 is configured such that the oil feeding port 23*b* and the oil feeding passage 23*a* are connected to form an oil feeding path of the piston pin 23. The oil feeding path of the piston pin 23 is connected to an oil feeding path (as will be described later) of the connecting rod 22.

The connecting rod 22 converts a turning motion of the eccentric shaft 10 into a reciprocating motion and transmits this reciprocating motion to the piston 16. The connecting rod 22 has a larger-end portion (one end portion) and a smaller-end portion (the other end portion). The larger-end portion is provided with the larger-shaft hole 22*a*, while the smaller-end portion is provided with the smaller-shaft hole 22*b*. The larger-shaft hole 22*a* and the smaller-shaft hole 22*b* penetrate the connecting rod 22 in the longitudinal direction (in a direction perpendicular to an extending direction of the connecting rod 22). The eccentric shaft 10 is fittingly inserted into the larger-shaft hole 22*a*. The piston pin 23 is fittingly inserted into the smaller-shaft hole 22*b*. The oil feeding groove 10*c* is formed between the larger-shaft hole 22*a* and the eccentric shaft 10. The oil groove 23*c* is formed between the smaller-shaft hole 22*b* and the piston pin 23. The communicating passage 22*c* is provided between the oil feeding groove 10*c* and the oil groove 23*c*. The smaller-end portion is provided with the communicating hole 22*d*.

The oil feeding groove 10*c* is formed on the outer peripheral surface of the fitting insertion portion of the eccentric shaft 10, or the inner peripheral surface of the larger-shaft hole 22*a* of the connecting rod 22. The oil feeding groove 10*c*, together with the oil feeding hole 10*b*, cause the oil feeding passage 10*a* and the communicating passage 22*c* to be communicated with each other. In the present embodiment, the oil feeding groove 10*c* is provided over the entire outer periphery of the eccentric shaft 10, and has a constant depth.

The oil groove 23*c* is provided in the inner peripheral surface of the smaller-shaft hole 22*b* or the outer peripheral surface of the piston pin 23. The oil groove 23*c* causes the communicating passage 22*c* to be communicated with the communicating hole 22*d* and the oil feeding port 23*b*. As will be described later, the oil groove 23*c* performs an oil feeding function via the oil feeding port 23*b* and a discharging function of the solid substances via the communicating hole 22*d*.

The communicating passage 22*c* penetrates the connecting rod 22 in an extending direction of the connecting rod 22 such that one end of the communicating passage 22*c* opens in the larger-shaft hole 22*a* and the other end of the communicating passage 22*c* opens in the smaller-shaft hole 22*b*. The communicating passage 22*c* causes the oil feeding groove 10*c* and the oil groove 23*c* to be communicated with each other.

One end of the communicating hole 22*d* opens in the smaller-shaft hole 22*b* and is communicated with the oil groove 23*c*. The other end of the communicating hole 22*d* opens in an end surface of the smaller-end portion and is communicated with the internal space 16*b* of the piston 16. The communicating hole 22*d* is provided in a location which is most distant from the communicating passage 22*c*. That is, the location at which the communicating hole 22*d* opens in the smaller-shaft hole 22*b* and the location at which the communicating passage 22*c* opens in the smaller-shaft hole 22*b* are symmetrical with respect to a point which is the center axis of the piston pin 23. Because of this, the oil from the communicating passage 22*c* flows uniformly in the entire oil groove 23*c* and reaches the communicating hole 22*d*.

In the above described manner, the connecting rod 22 is configured such that the oil feeding groove 10*c*, the communicating passage 22*c*, the oil groove 23*c* and the communicating hole 22*d* are connected to each other to form an oil feeding path of the connecting rod 22. Via the oil feeding path of the connecting rod 22, the oil feeding path of the shaft 12 and the oil feeding path of the piston pin 23 are connected to each other to form an oil feeding path of the container 1.

Next, a description will be hereinafter given of an operation of the reciprocating compressor having the above configuration, in conjunction with the working fluid 3.

When a current is applied to the electric component 6, the rotor 8 of the electric component 6 rotates the main shaft 11. According to the rotation of the main shaft 11, the eccentric shaft 10 rotates (turns) eccentrically in a direction of an arrow x of FIG. 3. This rotational motion of the eccentric shaft 10 is converted into the reciprocating motion via the connecting rod 22 and the reciprocating motion is transmitted to the piston 16. This allows the piston 16 to reciprocate in the compression chamber 13 of the cylinder 14. During the reciprocating motion of the piston 16, the working fluid 3 is suctioned from a cooling system (not shown) into the compression chamber 13, in a suction stroke. Further, in a compression stroke (discharge stroke), the working fluid 3 is discharged from the compression chamber 13 to the cooling system. This operation is repeated and the working fluid 3 is circulated in the cooling system. Thus, the refrigeration cycle is performed.

Next, a description will be hereinafter given of an operation of the reciprocating compressor having the above configuration, in conjunction with the oil 2.

Figure 4:
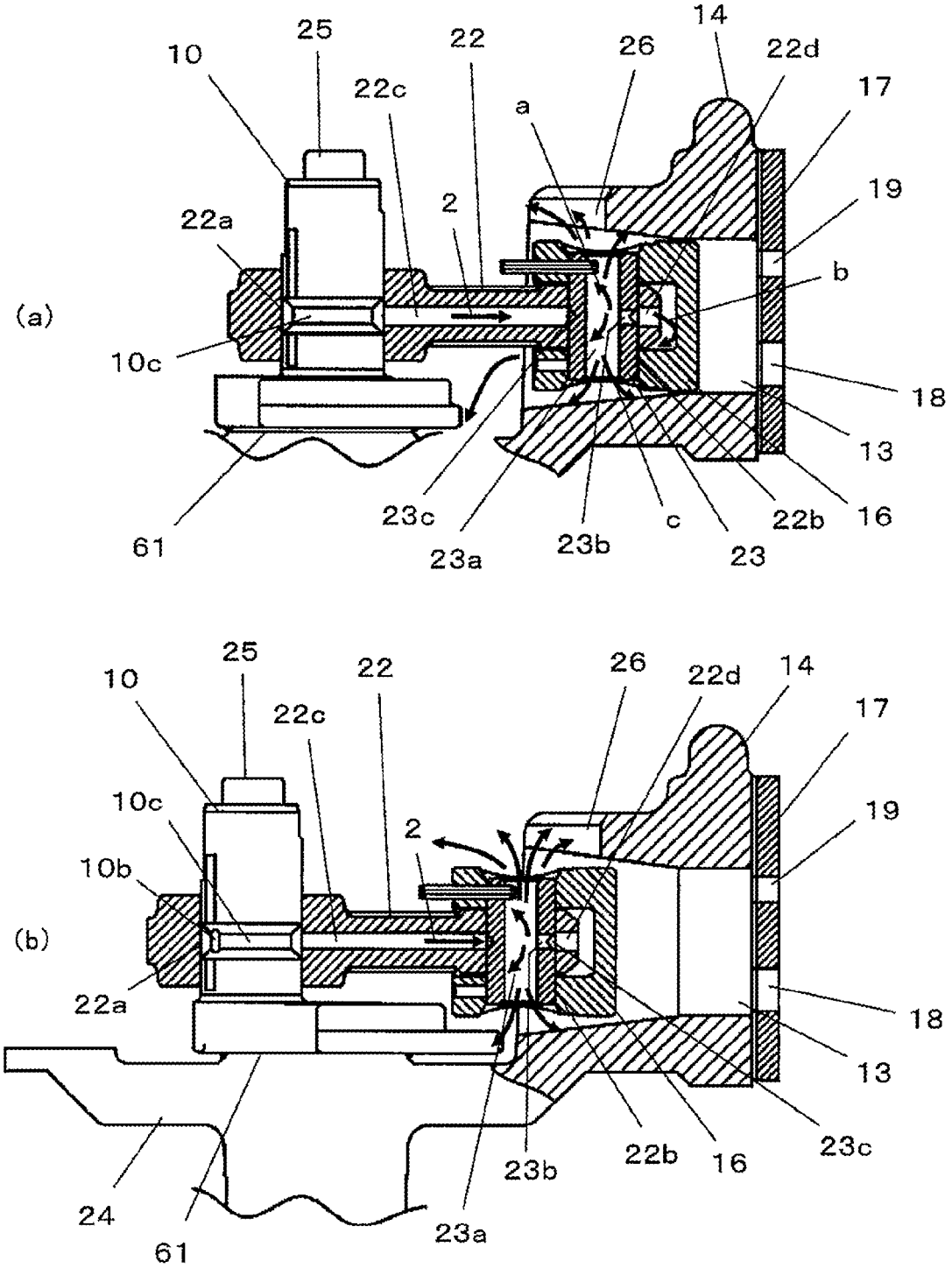
FIG. 4 is a schematic view for explaining a flow of oil in the slide portions of FIG. 2.

FIG. 4A shows a state in which the piston 16 is in a position between the top dead center and the bottom dead center. FIG. 4B shows a state in which the piston 16 is near the bottom dead center.

As shown in FIG. 1, when the shaft 12 rotates, the oil 2 stored in the bottom portion of the container 1 is suctioned up into the pump. By an action of the pump utilizing a centrifugal force, the oil 2 is suctioned up through the oil feeding mechanism 51 of the main shaft 11. The oil 2 flows from the oil feeding mechanism 51 into the oil feeding passage 10*a* of the eccentric shaft 10, and further flows upward. The oil 2 flows from the oil feeding passage 10*a* into the communicating passage 22*c* of the connecting rod 22 via the oil feeding hole 10*b* and the oil feeding groove 10*c*.

As shown in FIG. 4A, the oil 2 flows through the communicating passage 22*c* and then flows through the oil groove 23*c* between the connecting rod 22 and the piston pin 23. Here, the oil 2 is separated to flow into the oil feeding port 23*b* side as indicated by arrow a and the communicating hole 22*d* side as indicated by arrow b.

At this time, the oil 2 flowing into the oil groove 23*c* contains the solid substances such as abrasion powder generated in each slide portion of the main bearing 60 of the bearing unit 24, or the like. However, when the oil 2 is flowing through the annular oil groove 23*c* in a rotational direction, the solid substances are centrifugally separated because the solid substances have a greater specific gravity (weight) than the oil 2. Therefore, the solid substances migrate to an outer peripheral side of the oil groove 23*c* and gather in the smaller-shaft hole 22*b* side of the connecting rod 22. The solid substances migrate into the communicating hole 22*d* located outward relative to the oil groove 23*c* and are discharged into the container 1 through the internal space 16*b* of the piston 16.

The oil 2 from which the solid substances have been removed, flows to the oil feeding port 23*b* located inward relative to oil groove 23*c*. In particular, the oil feeding port 23*b* extends at a substantially right angle with respect to the flow of the oil 2 flowing through the oil groove 23*c*, and therefore, the solid substances having a greater specific gravity are less likely to flow into the oil feeding port 23*b*. Therefore, it is possible to suppress a situation in which the solid substances are fed from the oil feeding port 23*b* to the slide portion of the piston 16.

The oil 2 flowing to the communicating hole 22*d* side as indicated by arrow b flows out from the oil groove 23*c* to the internal space 16*b* of the piston 16 via the communicating hole 22*d* of the connecting rod 22, together with the solid substances. However, because of a greater specific gravity, most of the solid substances fall from the internal space 16*b* of the piston 16 to the bottom portion of the container 1. Because of a smaller specific gravity, the oil 2 in the internal space 16*b* flows through a clearance between the connecting rod 22 and the piston 16 and is scattered toward the shaft 12. A part of the oil 2 is fed to a region between the lower portion of the eccentric shaft 10 and the thrust bearing 61 and lubricates slide portions of them.

The oil 2 flowing to the oil feeding port 23*b* side as indicated by arrow a flows from the oil groove 23*c* into the oil feeding passage 23*a* through the oil feeding port 23*b* of the piston pin 23 as indicated by arrow a. As indicated by arrow c, the oil 2 flows out from the openings of the upper and lower ends of the oil feeding passage 23*a* to the outer peripheral surface of the piston 16. A part of the oil 2 flows into the compression chamber 13 and lubricates the slide portions of the piston 16 and of the cylinder 14.

The remaining oil 2 is scattered from outside of the compression chamber 13 into the internal space of the container 1. At this time, as shown in FIG. 4A, a part of the oil 2 scattered is fed to the region between the lower portion of the eccentric shaft 10 and the thrust bearing 61 and lubricates the slide portions of them.

Next, a description will be given of an action of the oil 2 in the slide portions of the piston 16 and of the cylinder 14.

Figure 5:
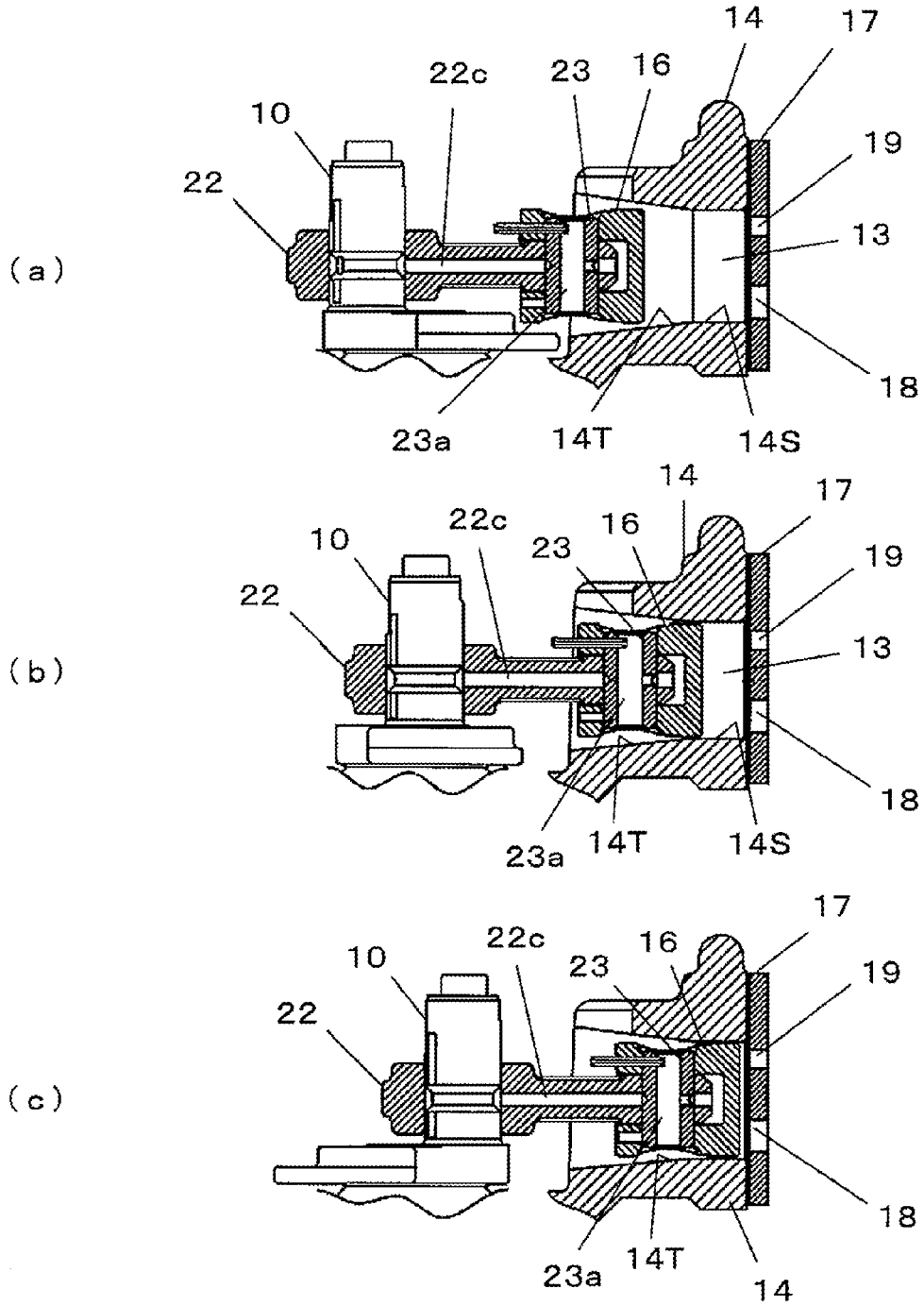
FIG. 5 is a schematic view for explaining an operation of the slide portions of FIG. 2.

FIG. 5A shows a state in which the piston 16 is in a position near the bottom dead center. FIG. 5B shows a state in which the piston 16 is in a position between the top dead center and the bottom dead center. FIG. 5C shows a state in which the piston 16 is in a position near the top dead center.

The piston 16 moves from the bottom dead center position of FIG. 5A toward the top dead center and thereby the working fluid 3 is compressed. As shown in FIG. 5B, in this initial state of the compression, a pressure increase inside of the compression chamber 13 is less. Because of this, even when there is a relatively great clearance between the taper section 14T of the cylinder 14 and the piston 16, the working fluid 3 is less likely to leak out from the compression chamber 13 because of a sealing effect produced by the plenty of oil 2 fed to the outer peripheral surface of the piston 16.

Since there is a relatively great clearance between the taper section 14T and the piston 16, the piston 16 easily rotates around the axis of the piston pin 23 and easily contacts the cylinder 14. Since the plenty of oil 2 is fed to the region (clearance) between the piston 16 and the taper section 14T and is formed into a uniform oil film on the outer peripheral surface of the piston 16. This can reduce a sliding resistance between the outer peripheral portion of the piston 16 and the inner peripheral portion of the cylinder 14, and hence a driving power loss in them is less. Even when the piston 16 contacts the cylinder 14 in a pressurized state, a driving power loss in the piston 16 is reduced, and generation of a friction noise can be suppressed.

When the piston 16 further moves inside of the compression chamber 13, the pressure of the working fluid 3 increases. As shown in FIG. 5C, in a state immediately before the piston 16 reaches the position near the top dead center, there is a small clearance between the piston 16 and the straight section 14S of the cylinder 14. Therefore, the oil 2 seals this clearance, which makes it possible to prevent the working fluid 3 from leaking out from the compression chamber 13.

Furthermore, the oil 2 lubricates the slide portions of the piston 16 and of the straight section 14S of the cylinder 14, thereby reducing a driving power loss in the slide portions, and preventing a friction noise from being generated there.

In accordance with the reciprocating compressor configured as described above, the opening of the upper end 62 of the oil feeding passage 10*a* is sealed (closed) by the sealing member 25. Because of this, the oil 2 is not scattered out from the upper portion of the eccentric shaft 10. Therefore, the working fluid 3 is not heated by the high-temperature oil 2. Therefore, an increase in the specific volume of the working fluid 3 can be suppressed, and the amount of the working fluid 3 flowing into the compression chamber 13 is not reduced. As a result, the amount of the working fluid 3 discharged from the compression chamber 13 is not reduced, and hence the volumetric efficiency of the reciprocating compressor is maintained.

In addition, it is possible to prevent a situation in which the working fluid 3 is mixed into the oil 2 scattered, and hence prevent a situation in which this working fluid 3 forms a hole in the lubricating film of the oil 2. Since the lubricating film of the oil 2 is thus formed on the entire slide portions, generation of friction and wear in the slide portions can be prevented, and a driving power loss in the slide portions can be suppressed.

The solid substances contained in the oil 2 are centrifugally separated in the oil groove 23*c*. The separated solid substances are discharged from the communicating hole 22*d* located outward relative to the oil groove 23*c* to the internal space 16*b* of the piston 16. Most of the solid substances migrate from the internal space 16*b* to inside of the container 1, and enter a storage section of the oil 2, or the like, in the bottom portion of the container 1. Because of this, it is possible to prevent a situation in which the solid substances enter a clearance between the slide portions, and damage the slide portions. This makes it possible to prevent reduction of a life of the reciprocating compressor, which would be caused by the solid substances.

The oil 2 from which the solid substances have been removed, flows to the oil feeding passage 23*a* via the oil feeding port 23*b* located inward relative to the oil groove 23*c*, and further into the compression chamber 13. Inside of the compression chamber 13, the oil 2 lubricates the slide portions of the piston 16 and of the cylinder 14. Therefore, friction in the slide portions can be prevented, a driving power loss in the slide portions can be reduced, and generation of a noise caused by the friction in the slide portions can be prevented. In addition, sliding is maintained such that the slide portions are not damaged by the solid substances. As a result, it becomes possible to prevent reduction of the life of the reciprocating compressor which would be caused by the solid substances.

The oil 2 flowing into the compression chamber 13 stays in the clearance between the piston 16 and the cylinder 14, which makes it possible to prevent the working fluid 3 from flowing out from inside of the compression chamber 13 through this clearance. As a result, reduction of the working fluid 3 discharged from the compression chamber 13 can be prevented, and the volumetric efficiency of the reciprocating compressor can be improved.

Since the oil feeding port 23*b* is provided in the location facing the location at which the communicating hole 22*d* opens in the smaller-shaft hole 22*b*, the oil 2 flows uniformly through the oil groove 23*c*. Because of this, the pressure and the oil film between the piston pin 23 and the connecting rod 22 become uniform.

By changing a diameter of the oil feeding port 23*b*, the amount of the oil 2 fed to the outer peripheral portion of the piston 16 via the oil feeding port 23*b* can be adjusted. Therefore, the oil of a proper amount corresponding to an outer diameter of the piston 16 can be fed. Thus, it becomes possible to attain reduction of the driving power loss in the slide portions of the piston 16 and of the cylinder 14, and reduction of excess inflow of the oil 2 to the compression chamber 13, in a well-balanced manner.

When the eccentric shaft 10 is rotating inside of the larger-shaft hole 22*a* of the connecting rod 22, it does not close the communicating passage 22*c* of the connecting rod 22. Therefore, the annular oil feeding groove 10*c* causes the oil feeding hole 10*b* and the communicating passage 22*c* to be communicated with each other all the time. This allows the oil 2 to flow through the communicating passage 22*c* and to be fed continuously to the slide portions of the piston 16 and of the cylinder 14 through the oil feeding port 23*b* and the communicating hole 22*d*. As a result, the driving power loss in the slide portions can be reduced, and the volumetric efficiency of the reciprocating compressor can be improved.

Embodiment 3

Figure 6:
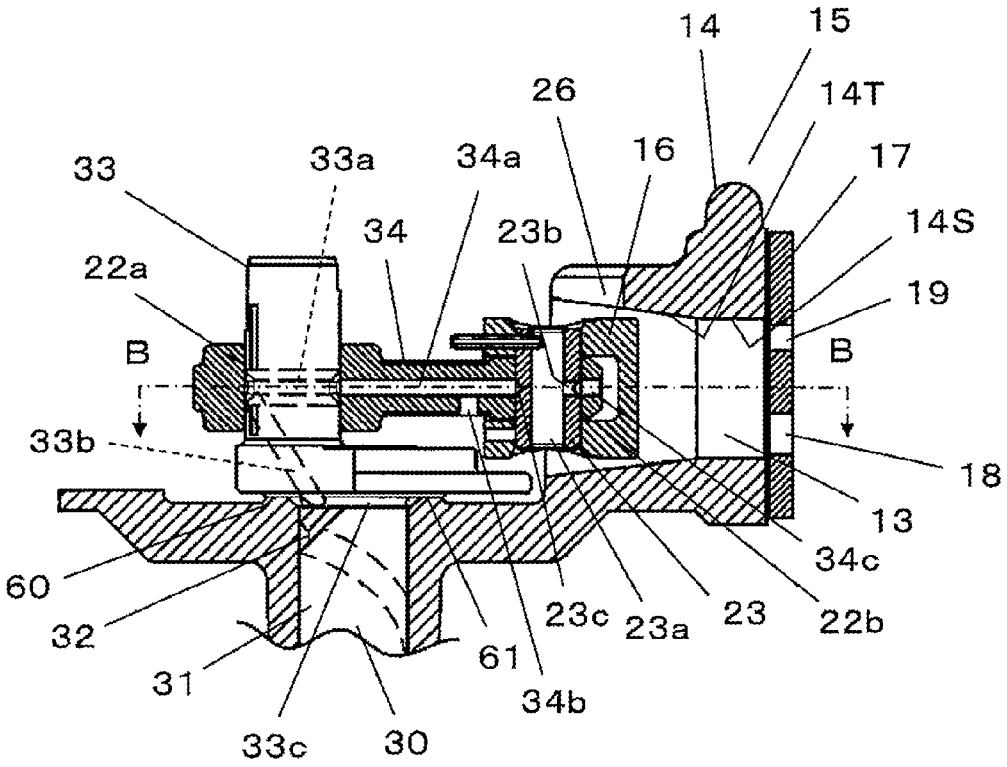
FIG. 6 is an enlarged sectional view showing slide portions of a reciprocating compressor according to Embodiment 3 of the present invention.
Figure 7:
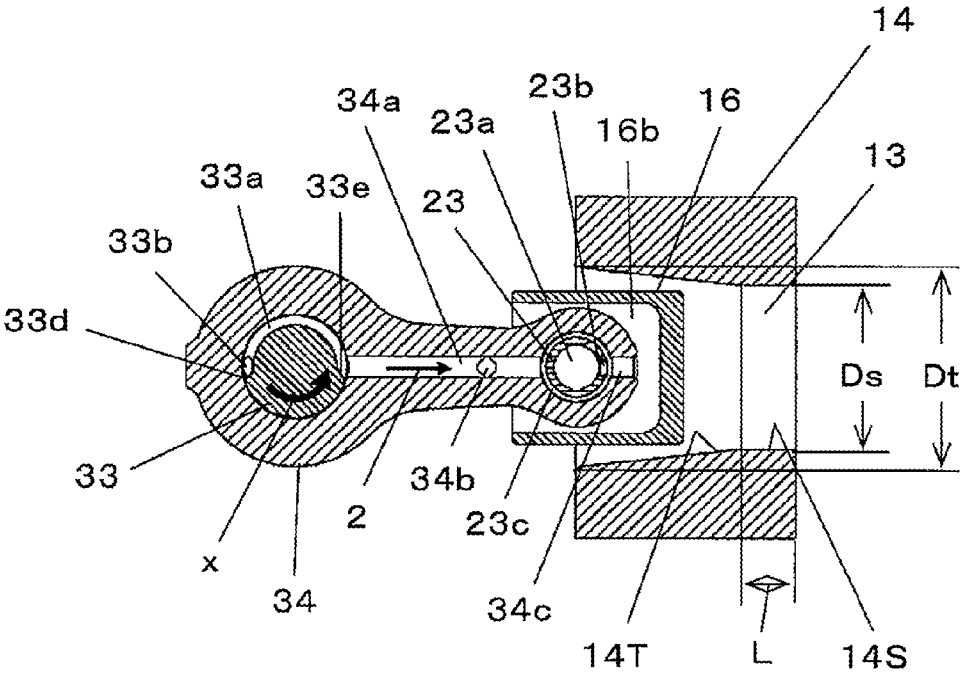
FIG. 7 is a cross-sectional view showing the slide portions taken along line B-B of FIG. 6.

FIG. 6 is an enlarged longitudinal sectional-view of a reciprocating compressor according to Embodiment 3. FIG. 7 is a cross-sectional view of a region in the vicinity of the piston 16, which is taken along line B-B of FIG. 6.

The oil feeding mechanism 32 is configured such that a tip end thereof closer to an oil feeding target opens in an oil holding groove 33*c*. The oil feeding groove 33*c* is formed in a region of an outer peripheral surface of a main shaft 31 which faces the main bearing 60, over the entire circumference. The oil holding groove 33*c* is formed by cutting the main shaft 31 such that the diameter of the main shaft 31 is a little reduced.

A lower end of an oil feeding passage 33*b* is communicated with the oil feeding mechanism 32 and the oil holding groove 33*c*. An upper end of the oil feeding passage 33*b* is not communicated with an upper surface of the eccentric shaft 33 but with an oil feeding groove 33*a* as will be described later. The oil feeding passage 33*b* is formed to penetrate the eccentric shaft 33 by a drilling machine such as an end mill or a drill press.

The eccentric shaft 33 has a circular cross-section. In a state in which the eccentric shaft 33 is inserted into a larger-shaft hole of a connecting rod 34, an arch-shaped recess is formed in a portion of this circular cross-section. Because of this, the circular portion of the eccentric shaft 33 contacts the inner surface of the larger-shaft hole such that the circular portion conforms in shape to the inner surface of the larger-shaft hole. The arch-shaped recess portion of the eccentric shaft 33 is apart from the larger-shaft hole, and the oil feeding groove 33*a* is provided in this gap.

Figure 12:
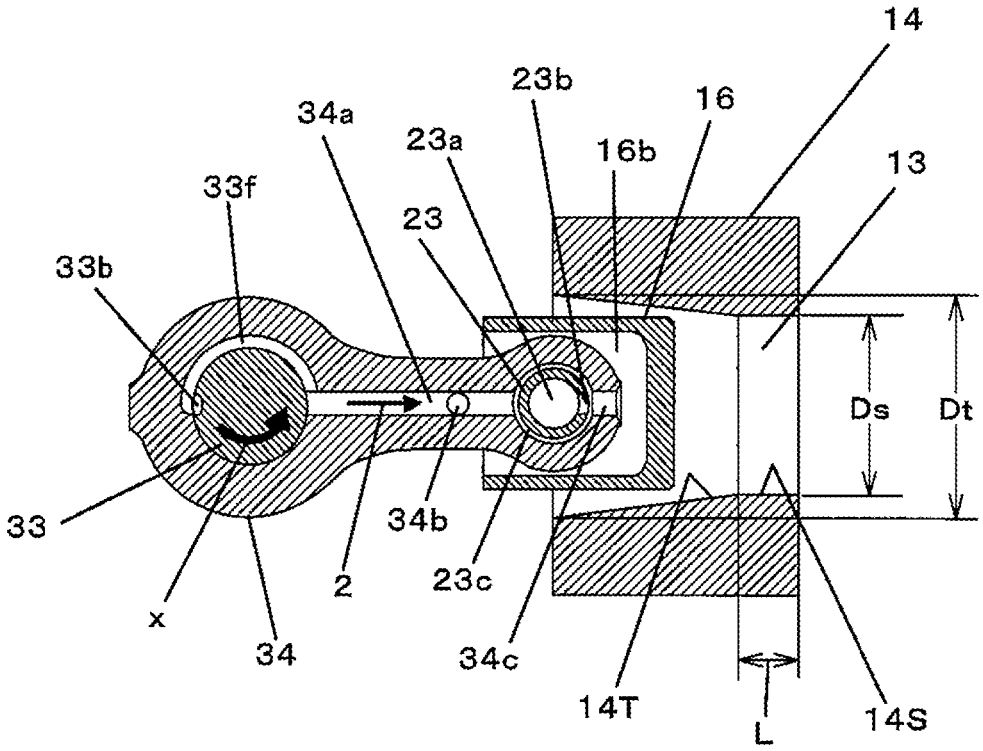
FIG. 12 is a cross-sectional view showing slide portions according to a modified example.

The oil feeding groove 33*a* is defined by an arc-shaped gap between an outer peripheral surface of a fitting insertion portion of the eccentric shaft 33 and an inner peripheral surface of the larger-shaft hole of the connecting rod 34. The oil feeding groove 33*a* is configured such that a width between the outer peripheral surface of the fitting insertion portion of the eccentric shaft 33 and the inner peripheral surface of the larger-diameter hole of the connecting rod 34, i.e., width of the oil feeding groove 33*a* of the arc-shaped gap, decreases as it is closer to its starting end 33*d* and its terminal end 33*e*. Relative positions of the oil feeding groove 33*a* and the connecting rod 34 change according to the rotation (turn) of the eccentric shaft 33. When the piston 16 is moving in a direction to increase the volume of the compression chamber 13 (suction stroke), the oil feeding groove 33*a* causes the oil feeding passage 33*b* and the communicating passage 34*a* be substantially communicated with each other. By comparison, when the piston 16 is moving in a direction to reduce the volume of the compression chamber 13 (discharge stroke (compression stroke)), the oil feeding groove 33*a* causes the oil feeding passage 33*b* and the communicating passage 34*a* not to be substantially communicated with each other. In a strict sense, the oil feeding passage 33*b* and the communicating passage 34*a* are slightly communicated with each other via a clearance between the larger-shaft hole of the connecting rod 34 and the eccentric shaft 33. The phrase "be substantially communicated with each other, or not communicated with each other." means that "communicated with each other, or not substantially communicated with each other in a case where the clearance is ignored." Specifically, the oil feeding groove 33*a* is formed in an angular range (angular range of 180 degrees at an upper side in FIG. 7) in which the eccentric shaft 33 rotates relative to the connecting rod 34, in the suction stroke of the piston 16. As shown in FIG. 12, instead of the oil feeding groove 33*a* at the eccentric shaft 22 side, an oil feeding groove 33*f* may be formed in the inner peripheral surface of the larger-shaft hole of the connecting rod 34. In this case, the eccentric shaft 33 has a circular cross-section. The oil feeding groove 33*a* is formed in an angular range of 180 degrees at an upper side in FIG. 12. When the piston 16 is in the suction stroke, the oil feeding passage 33*b* is communicated with the oil feeding groove 33*f*.

The communicating passage 34*a* has a discharge hole 34*b*.

The discharge hole 34*b* is formed in a wall surface of the communicating passage 34*a* in an intermediate position thereof at the thrust bearing 61 side (side where a gravitational force acts). The discharge hole 34*b* is provided to extend in a direction which is substantially perpendicular to the communicating passage 34*a* and penetrates the connecting rod 34 in a vertically downward direction. The discharge hole 34*b* causes the communicating passage 34*a* and inside of the container 1 to be communicated with each other.

Next, a description will be given of an operation of the reciprocating compressor having the above configuration, in conjunction with the oil 2, in the suction stroke and the compression stroke.

According to a rotation of the shaft 30, the eccentric shaft 33 performs a turn motion in a direction indicated by an arrow x of FIG. 7.

In the suction stroke, the piston 16 moves from the top dead center to the bottom dead center so as to increase the volume of the compression chamber 13. At this time, the circular portion of the eccentric shaft 33 which contacts the inner surface of the larger-shaft hole such that the circular portion conforms in shape to the inner surface of the larger-shaft hole is located between the communicating passage 34*a* and the oil feeding passage 33*b*. The oil feeding groove 33*a* expands to a range including the communicating passage 34*a* and the oil feeding passage 33*a*. The communicating passage 34*a* and the oil feeding passage 33*a* open in the oil feeding groove 33*a*, and these are communicated with each other. This allows the oil 2 to flow from the oil holding groove 33*c* through the communicating passage 34*a* via the oil feeding passage 33*b* and the oil feeding groove 33*a*.

The width of the oil feeding groove 33*a* of the arc-shaped gap gradually decreases as it is closer to its starting end 33*d* and its terminal end 33*e*. This makes it possible to suppress a rapid pressure change in the oil 2 when the oil 2 is flowing from the oil feeding passage 33*b* to the starting end 33*d* of the oil feeding groove 33*a*. In addition, it becomes possible to lessen a rapid pressure change in the oil 2 when the oil is flowing from the terminal end 33*e* of the oil feeding groove 33*a* to the communicating passage 34*a*. Thereby, the oil 2 smoothly flows into the communicating passage 34*a* in a state in which the flow of the oil 2 is not disordered. Also, it becomes possible to prevent a situation in which the working fluid 3 dissolved in the oil 2 is changed into bubbles due to the rapid pressure change. As a result, the amount of the oil 2 flowing through the communicating passage 34*a* can be stabilized.

A part of the oil 2 flowing through the communicating passage 34*a* flows downward from the communicating passage 34*a* to the discharge hole 34*b* and is discharged into the internal space of the container 1. At this time, the solid substances and the working fluid 3 contained in the oil 2 fall from the discharge hole 34*b* and are discharged from the communicating passage 34*a*. The solid substances having a greater specific gravity fall onto the storage section of the oil 2, or the like, in the bottom portion of the container 1. Meanwhile, the working fluid 3 is released from the narrow communicating passage 34*a* to the wide container 1, and thereby is separated from the oil 2. Thus, the flow of the oil 2 is not impeded by the solid substances and the bubbles of the working fluid 3. Therefore, as will be described later, the oil 2 is stably fed to the oil feeding passage 23*a*, and thereby is sufficiently fed to the slide portion of the piston 16 to lubricate the slide portion.

The oil 2 discharged from the discharge hole 34*b* flows into a region (clearance) between the lower portion of the eccentric shaft 33 and the thrust bearing 61 at the upper portion of the main bearing 60, as shown in FIG. 6, and lubricates their slide portions.

Most of the remaining oil 2 flows to the oil groove 23*c* of the piston pin 23. The solid substances are centrifugally separated from the oil 2. The separated solid substances are discharged from the communicating hole 34*c*. The oil 2 from which the solid substances have been separated flows from the oil feeding port 23*b* into the inside of the container 1 via the oil feeding passage 23*a*. At this time, because of the suction stroke, the pressure in the compression chamber 13 is lower than a suction pressure, i.e., the pressure inside of the container 1. Due to this pressure difference, the oil 2 which has flowed into the container 1 flows easily into the clearance between the piston 16 and the cylinder 14. Therefore, the plenty of oil 2 is fed to the slide portions of the piston 16 and of the cylinder 14. Thus, the oil 2 is formed into a uniform oil film on the slide portions, and stays between the piston 16 and the cylinder 14, which prevents the working fluid 3 from flowing out from the inside of the compression chamber 13.

In the compression stroke, the piston 16 moves from the bottom dead center to the top dead center so as to reduce the volume of the compression chamber 13. The oil feeding groove 33*a* moves in the direction indicated by the arrow x in FIG. 7. According to this movement, the outer peripheral wall of the circular portion of the eccentric shaft 33 moves while contacting the inner surface of the larger-shaft hole such that the circular-portion conforms in shape to the inner surface of the larger-shaft hole, and closes the communicating passage 34*a*. As a result, the oil 2 in the oil holding groove 33*c* does not flow from the communicating passage 34*a* via the oil feeding passage 33*b* and the oil feeding groove 33*a*, but flows into the clearance of the thrust bearing 61. The oil 2 lubricates a slide surface of the thrust bearing 61 and flows out into the container 1.

Especially in the compression stroke, the piston 16 receives a stress from the working fluid 3 inside of the compression chamber 13. The connecting rod 34 connected to the piston 16 via the piston pin 23 is pushed toward the eccentric shaft 33. At this time, the oil feeding groove 33*a* is not located at the connecting rod 34 side. The outer peripheral surface of the eccentric shaft 33 contacts the larger-shaft hole of the connecting rod 34 in a position where the eccentric shaft 33 closes the communicating passage 34*a*. This can ensure a greater area of the outer peripheral surface of the eccentric shaft 33 which receives the pressure from the connecting rod 34. Since the connecting rod 34 does not contact the eccentric shaft 33 in a small range, wear of a localized portion of an edge of the oil feeding groove 33*a* can be suppressed, and durability and reliability of the eccentric shaft 33 can be improved.

In accordance with the reciprocating compressor having the above configuration, the oil 2 is fed to the slide portions of the piston 16 and of the cylinder 14, and to the thrust bearing 61, in an alternate manner. These slide portions are lubricated, and as a result, a driving power loss in the whole reciprocating compressor can be reduced.

In the suction stroke, the oil feeding groove 33*a* and the communicating passage 34*a* are communicated with each other. This allows the oil 2 in the oil holding groove 33*c* to flow out into the container 1 via the oil feeding passage 33*b*, the oil feeding groove 33*a*, the communicating passage 34*a*, the oil groove 23*c*, the oil feeding port 23*b* and the oil feeding passage 23*a*. Since the pressure in the compression chamber 13 is lower than the pressure inside of the container 1, most of the oil 2 inside of the container 1 is fed to the slide portions of the piston 16 and of the cylinder 14. Therefore, the oil 2 can reduce a driving power loss in the slide portions and prevent wear and seizure of the slide portions, which can extend the life of the reciprocating compressor. In addition, since the oil 2 serves to prevent the working fluid 3 from flowing out from the compression chamber 13, reduction of the volumetric efficiency of the reciprocating compressor can be suppressed.

Since the width of the oil feeding groove 33*a* decreases toward the starting end 33*d* and toward the terminal end 33*e*, a rapid change in the pressure of the oil 2 can be suppressed. The amount of the oil 2 flowing into the communicating passage 34 can be stabilized. Since the solid substances and the working fluid 3 are discharged from the discharge hole 34*b*, the amount of the oil 2 flowing through the communicating passage 34*a* can also be stabilized. The oil 2 having flowed through the communicating passage 34*a* is sufficiently fed to the slide portion of the piston 16. As a result, the slide portion can be lubricated, a driving power loss in the slide portion can be reduced, and the life of the reciprocating compressor can be extended.

The oil 2 fed to the slide portion of the piston 16 is free from the solid substances, because they have been removed in the communicating hole 34*c* and the discharge hole 34*b*. This makes it possible to prevent a situation in which the solid substances get stuck in the slide portion of the piston 16, for example, which can extend the life of the reciprocating compressor.

In the compression stroke, the oil 2 in the oil holding groove 33*c* is actively fed to the thrust bearing 61 side. Because of this, friction and wear in the thrust bearing 61 can be further reduced. Since the eccentric shaft 33 can receive the force applied from the connecting rod 34 with a great area, wear of a localized region of the eccentric shaft 33 can be prevented. As a result, the driving power loss in these components can be further reduced, and the life of the reciprocating compressor can be further extended.

The upper end of the oil feeding passage 33*b* does not open in the upper end of the eccentric shaft 33 but opens in the vicinity of the oil feeding groove 33*a*. Because of this, even when the upper end opening of the oil feeding passage 33*b* is not sealed (closed) by a sealing member, the oil 2 is not scattered out from the upper end opening of the oil feeding passage 33*b* to inside of the container 1. This eliminates a need for a sealing member, which can make an assembling work of the reciprocating compressor easier and improve a productivity of the reciprocating compressor. Furthermore, the working fluid 3 is not heated by the oil 2, and hence the volumetric efficiency of the reciprocating compressor can be improved.

Embodiment 4

Figure 8:
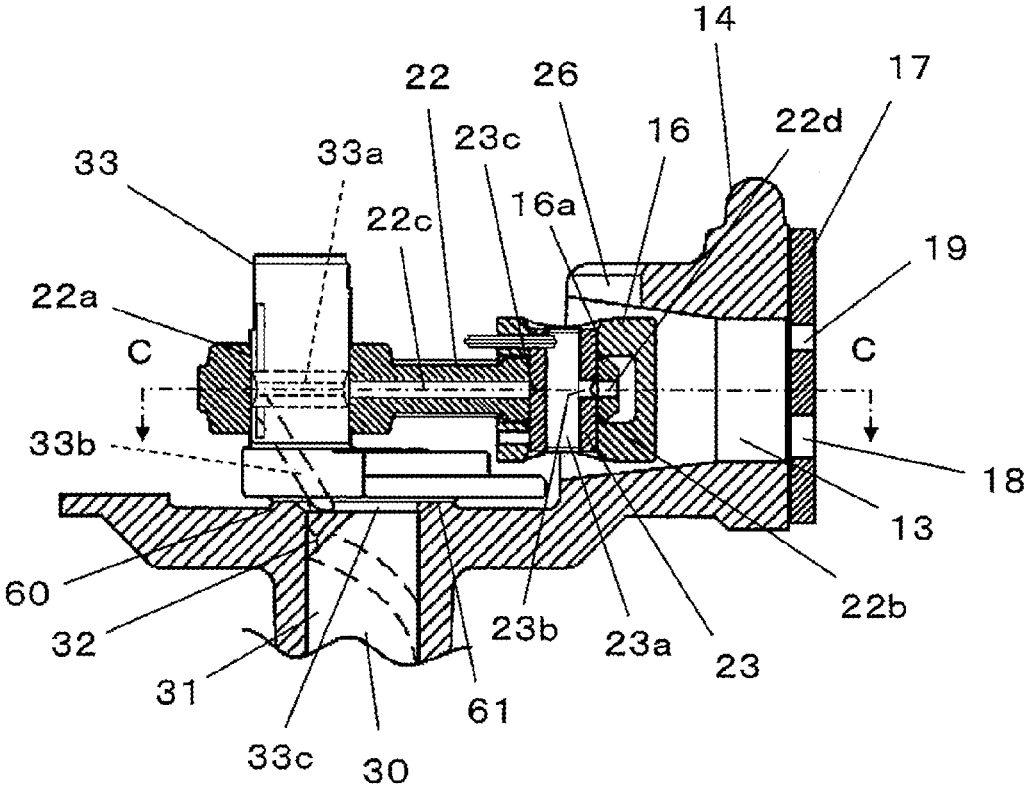
FIG. 8 is an enlarged sectional view showing slide portions of a reciprocating compressor according to Embodiment 4 of the present invention.
Figure 9:
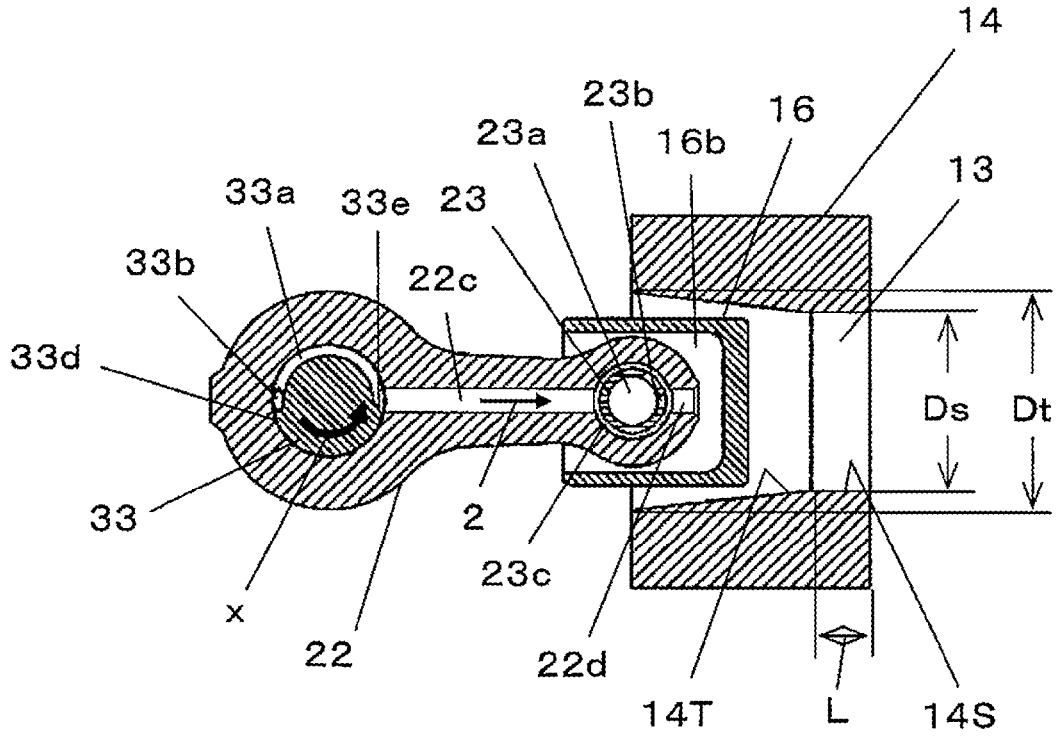
FIG. 9 is a cross-sectional view showing the slide portions taken along line C-C of FIG. 8.

FIG. 8 is an enlarged longitudinal sectional view showing a region in the vicinity of the piston 16 of a reciprocating compressor according to Embodiment 4. FIG. 9 is a cross-sectional view taken along C-C of FIG. 8.

Although in Embodiment 3, the connecting rod 34 is provided with the discharge hole 34*b*, it need not be provided with the discharge hole as in the connecting rod 22 of Embodiment 2, as shown in FIGS. 8 and 9.

In this case, it is possible to achieve advantages of Embodiment 3 other than the advantage provided by the discharge hole 34*b*

Although in Embodiment 1 and 2, the oil feeding hole 10*b* is provided in the location of the eccentric shaft 10 which is most distant from the communicating passage 22*c*, the location of the oil feeding hole 10*b* is not limited to this.

Although in Embodiment 2 to 4, the thrust bearing 61 is a plain bearing, the thrust bearing 61 is not limited to this. For example, a roller bearing using a thrust ball bearing may be used as the thrust bearing 61.

Figure 11:
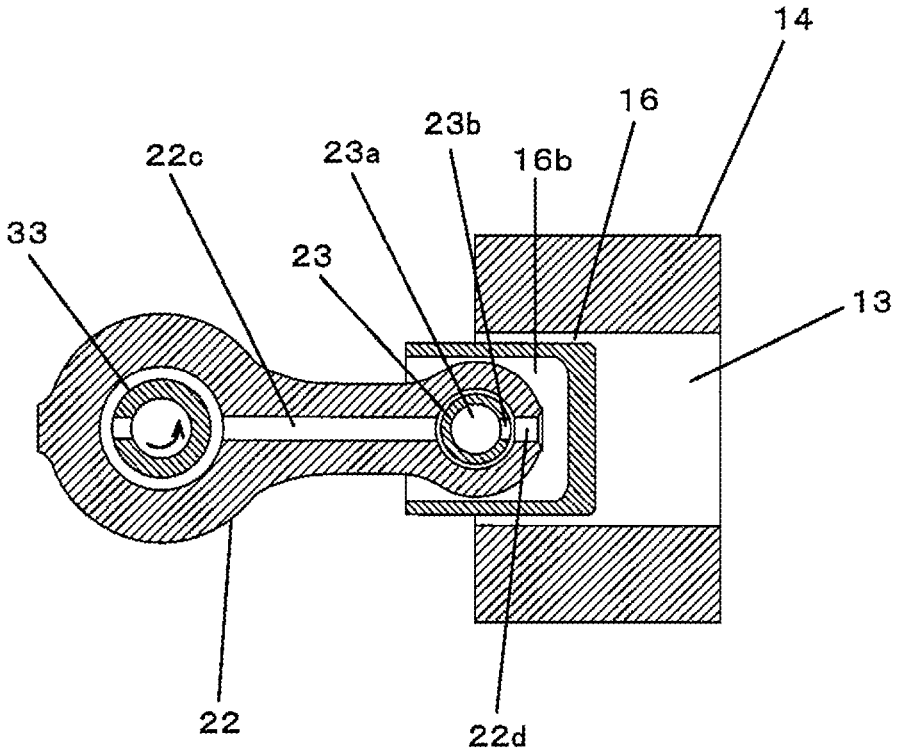
FIG. 11 is an enlarged sectional view showing slide portions of a piston and of a cylinder of FIG. 10.

In Embodiment 2 to 4, the cylinder 14 including the straight section 14S and the taper section 14T is used. Alternatively, like Embodiment 1, as shown in FIGS. 10 and 11, the cylinder 14 may have a straight shape over the whole length. In this case, the inner diameter dimension Ds is equal to the inner diameter dimension Dt in the cylinder 14.

In Embodiment 3, the discharge hole 34*b* is formed in the wall surface of the connecting rod 34 at the thrust bearing 61 side (side where the gravitational force acts). The location of the discharge hole 34*b* is not limited to this.

In Embodiment 3 and Embodiment 4, the oil feeding passage 33*b*, the upper end of which opens in the oil feeding groove 33*a*, is used. Alternatively, as in Embodiment 2, the oil feeding passage 10*a*, the upper end of which opens in the upper surface of the eccentric shaft 10, may be used. In this case, the oil feeding passage 10*a* is communicated with the oil feeding hole 10*b* which is communicated with the oil feeding groove 33*a*.

Although in the above described embodiments, the communicating hole 22*d* is provided in the connecting rod 34 in the location most distant from the communicating passage 22*c*, the location of the communicating hole 22*d* is not limited to this.

In the above described embodiments, the oil feeding port 23*b* is provided in the piston pin 23 in the location facing the communicating hole 22*d*. The location of the oil feeding port 23*b* is not limited so long as it is other than the location facing the communicating passage 22*c*.

The above described embodiments may be combined so long as the combination will not cause mutual exclusion.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

INDUSTRIAL APPLICABILITY

A reciprocating compressor of the present invention is useful as a reciprocating compressor or the like, which can reduce its driving power loss, improve its volumetric efficiency and extend its life.

REFERENCE SIGNS LIST

1 container
2 electric component
9 compression element
10, 33 eccentric shaft
11, 31 main shaft
13 compression chamber
14 cylinder
16 piston
16*b* internal space
22, 34 connecting rod
23 piston pin
22*a* larger-shaft hole
22*b* smaller-shaft hole
22*c*, 34*a* communicating passage
23*a* oil feeding passage
22*d*, 34*c* communicating hole
23*b* oil feeding port
23*c* oil groove
10*a*, 33*b* oil feeding passage
10*c*, 33*a* oil feeding groove
34*b* discharge hole

The invention claimed is:

1. A reciprocating compressor comprising:

an electric component;

a compression component actuated by the electric component; and a container which accommodates the electric component and the compression component and stores oil;

wherein the compression component includes:

a cylinder;

a piston which has an internal space which opens at an opposite side of a head portion thereof and is reciprocatable inside of the cylinder;

an eccentric shaft rotated by the electric component around an axis parallel to an axis of the eccentric shaft;

a piston pin provided in the piston so as to extend transversely in the internal space;

a connecting rod one end portion of which is rotatably fitted to the eccentric shaft and the other end portion of which is inserted into the internal space of the piston, the connecting rod being rotatably fitted to the piston pin in a smaller-shaft hole formed in the other end portion;

an oil feeding mechanism for feeding the oil stored in the container to a specified region of the connecting rod;

a communicating passage which is provided inside of the connecting rod such that the smaller-shaft hole and the specified region are in communication with each other via the communicating passage, and feeds the oil fed to the specified region by the oil feeding mechanism to the smaller-shaft hole, when the piston is in a suction stroke;

a first oil feeding passage which extends in an axial direction of the piston pin and opens in an outer peripheral surface of the piston;

a communicating hole which is provided in the connecting rod such that the smaller-shaft hole and the internal space of the piston are in communication with each other via the communicating hole, and discharges the oil fed to the smaller-shaft hole to the internal space of the piston; and an oil feeding port which is provided in the piston pin such that the first oil feeding passage and the smaller-shaft hole are in communication with each other via the oil feeding port and feeds the oil fed to the smaller-shaft hole to the first oil feeding passage;

wherein the oil feeding port is provided in the piston pin in a location other than a location facing a location at which the communicating passage opens in the smaller-shaft hole, wherein the specified region of the connecting rod is a larger-shaft hole which is formed at one end portion of the connecting rod and into which the eccentric shaft is fittingly inserted, the reciprocating compressor further comprising:

a main shaft having one end portion to which the eccentric shaft is connected such that an axis of the main shaft and the axis of the eccentric shaft are eccentric with respect to each other, the other end portion of the main shaft being immersed in the oil stored in the container, and the main shaft being rotated by the electric component around the axis of the main shaft;

wherein a second oil feeding passage is provided from the other end portion of the main shaft to an outer peripheral surface of a fitting insertion portion of the eccentric shaft which is fittingly inserted into the larger-shaft hole of the connecting rod, and feeds the oil stored in the container to the outer peripheral surface of the fitting insertion portion of the eccentric shaft, wherein an oil feeding groove provided in the outer peripheral surface of the fitting insertion portion of the eccentric shaft or an inner peripheral surface of the larger-shaft hole of the connecting rod such that the second oil feeding passage and the communicating passage are in communication with each other via the oil feeding groove, wherein the second oil feeding passage is provided in the eccentric shaft, wherein a cross-section of the oil feeding groove which is perpendicular to the axis of the eccentric shaft is arc-shaped, and wherein when the piston is in a suction stroke, the oil feeding groove causes the second oil feeding passage and the communicating passage to be substantially in communication with each other, when the piston is in a compression stroke, the oil feeding groove causes the second oil feeding passage and the communicating passage substantially not to be in communication with each other, the reciprocating compressor further comprising:

a discharge hole provided in the connecting rod such that the communicating passage and inside of the container are in communication with each other via the discharge hole.

2. The reciprocating compressor according to claim 1, further comprising:

an oil groove provided in an outer peripheral surface of the piston pin or an inner peripheral surface of the smaller-shaft hole of the connecting rod such that the communicating passage and the communicating hole are in communication with each other via the oil groove.

3. The reciprocating compressor according to claim 2, wherein the oil feeding port is provided in the piston pin such that the oil groove and the first oil feeding passage are in communication with each other via the oil feeding port.

4. The reciprocating compressor according to claim 1, wherein the oil feeding port is provided in the piston pin in a location facing a location at which the communicating hole opens in the smaller-shaft hole when the connecting rod is rotating relative to the piston pin.

5. The reciprocating compressor according to claim 1, wherein the oil feeding groove is configured such that a gap formed between the inner peripheral surface of the larger-shaft hole of the connecting rod and the outer peripheral surface of the fitting insertion portion of the eccentric shaft decreases as the gap is closer to its both ends.

6. A reciprocating compressor comprising:

an electric component;

a compression component actuated by the electric component; and a container which accommodates the electric component and the compression component and stores oil;

wherein the compression component includes:

a cylinder;

a piston which has an internal space which opens at an opposite side of a head portion thereof and is reciprocatable inside of the cylinder;

an eccentric shaft rotated by the electric component around an axis parallel to an axis of the eccentric shaft;

a piston pin provided in the piston so as to extend transversely in the internal space;

a connecting rod one end portion of which is rotatably fitted to the eccentric shaft and the other end portion of which is inserted into the internal space of the piston, the connecting rod being rotatably fitted to the piston pin in a smaller-shaft hole formed in the other end portion;

an oil feeding mechanism for feeding the oil stored in the container to a specified region of the connecting rod;

a communicating passage which is provided inside of the connecting rod such that the smaller-shaft hole and the specified region are in communication with each other via the communicating passage, and feeds the oil fed to the specified region by the oil feeding mechanism to the smaller-shaft hole, when the piston is in a suction stroke;

a first oil feeding passage which extends in an axial direction of the piston pin and opens in an outer peripheral surface of the piston;

a communicating hole which is provided in the connecting rod such that the smaller-shaft hole and the internal space of the piston are in communication with each other via the communicating hole, and discharges the oil fed to the smaller-shaft hole to the internal space of the piston; and an oil feeding port which is provided in the piston pin such that the first oil feeding passage and the smaller-shaft hole are in communication with each other via the oil feeding port and feeds the oil fed to the smaller-shaft hole to the first oil feeding passage;

wherein the oil feeding port is provided in the piston pin in a location other than a location facing a location at which the communicating passage opens in the smaller-shaft hole, wherein the specified region of the connecting rod is a larger-shaft hole which is formed at one end portion of the connecting rod and into which the eccentric shaft is fittingly inserted, the reciprocating compressor further comprising:

a main shaft having one end portion to which the eccentric shaft is connected such that an axis of the main shaft and the axis of the eccentric shaft are eccentric with respect to each other, the other end portion of the main shaft being immersed in the oil stored in the container, and the main shaft being rotated by the electric component around the axis of the main shaft;

wherein a second oil feeding passage is provided from the other end portion of the main shaft to an outer peripheral surface of a fitting insertion portion of the eccentric shaft which is fittingly inserted into the larger-shaft hole of the connecting rod, and feeds the oil stored in the container to the outer peripheral surface of the fitting insertion portion of the eccentric shaft, wherein an oil feeding groove provided in the outer peripheral surface of the fitting insertion portion of the eccentric shaft or an inner peripheral surface of the larger-shaft hole of the connecting rod such that the second oil feeding passage and the communicating passage are in communication with each other via the oil feeding groove, wherein the second oil feeding passage is provided in the eccentric shaft, wherein the oil feeding groove is defined by an arc-shaped gap between the eccentric shaft and the end portion of the connecting rod which is rotatably fitted to the eccentric shaft, and a cross-section of the oil feeding groove that is perpendicular to the axis of the eccentric shaft is arc-shaped, and wherein when the piston is in a suction stroke, the oil feeding groove causes the second oil feeding passage and the communicating passage to be substantially in communication with each other, and when the piston is in a compression stroke, the oil feeding groove causes the second oil feeding passage and the communicating passage substantially not to be in communication with each other, the reciprocating compressor further comprising:

a discharge hole provided in the connecting rod such that the communicating passage and inside of the container are in communication with each other via the discharge hole.

* * * * *